US005363997A

United States Patent [19]

Harris

[11] Patent Number: 5,363,997

[45] Date of Patent: Nov. 15, 1994

[54] TAPE DISPENSING DEVICE

[76] Inventor: Rod W. Harris, 2106-C Gallows Rd., Vienna, Va. 22182

[21] Appl. No.: 40,447

[22] Filed: Apr. 1, 1993

[51] Int. Cl.[5] ..... B26F 3/02

[52] U.S. Cl. ..... 225/25; 225/47; 225/56

[58] Field of Search ..... 225/25, 47, 26, 56, 225/77

[56] References Cited

U.S. PATENT DOCUMENTS

| | | | |
|---|---|---|---|
| D. 225,577 | 12/1972 | Boyce | D19/69 |
| D. 299,036 | 12/1988 | Harris | D19/69 |
| 2,609,877 | 9/1952 | Hanington | 225/25 |
| 2,677,425 | 5/1954 | Broyles | 225/88 X |
| 2,698,143 | 12/1954 | Pottle | 225/25 |
| 2,717,641 | 9/1955 | Wiederspan | 225/65 |
| 2,734,575 | 2/1956 | Gilbreath et al. | 225/56 |
| 2,734,576 | 2/1956 | Slezak | 225/65 |
| 2,793,694 | 5/1957 | Vogt | 225/25 X |
| 2,823,750 | 2/1958 | Vogt | 225/25 |
| 2,839,140 | 6/1958 | Vogt | 225/25 |
| 3,132,783 | 5/1964 | Duncan | 225/25 |
| 3,684,141 | 8/1972 | Hall | 225/65 |
| 4,238,272 | 12/1980 | Scleicher | 156/527 |
| 4,344,813 | 8/1982 | Holoff et al. | 156/527 |
| 4,627,560 | 12/1986 | Samuelson | 225/66 |
| 4,711,384 | 12/1987 | Harris | 225/56 |
| 4,881,675 | 11/1989 | Varley, III | 225/43 |
| 5,009,351 | 4/1991 | Handler | 225/52 |
| 5,171,397 | 12/1992 | Arnold | 156/523 |

OTHER PUBLICATIONS

3M Model A-122, undated (photograph).

"Adjustable Tension Dispensers" and "Cushioned Handle Dispensers"; Browncore International Catalog; Jan.-Apr. 1992.

"2" Deluxe Dispenser"; Consolidated Plastics Company Incorporated 1993 Catalog.

Photographs, Tape Dispenser Marketed By Manco (shown at left); Tape Dispenser Marketed by 3M (shown at right), Undated.

*Primary Examiner*—Richard K. Seidel

*Assistant Examiner*—Kenneth E. Peterson

*Attorney, Agent, or Firm*—Banner, Birch, McKie & Beckett

[57] ABSTRACT

A one-piece, core mounted tape dispensing and cutting device wherein the free end of the tape is restrained against being withdrawn onto the roll of tape. The cutter preferably includes a blade which is elevated above the plane of the tape. The tape is withdrawn tangentially from the tape roll between tape tabs, which support the tape, and a tape trap, which presses the tape against the tabs. The tape trap preferably is a spring loaded projection connected to the body of the cutter at the base of the elevated blade. The tape trap is hingedly connected to the base of the blade so that it presses against the tape tabs with a spring action.

15 Claims, 3 Drawing Sheets

TAPE DISPENSING DEVICE

This invention relates to a device for dispensing and cutting tape, such as ordinary adhesive tape as well as other types of tape products. More specifically, this invention relates to a one-piece, core mounted dispensing and cutting device wherein the free end of the tape is restrained against being withdrawn onto the roll of tape.

BACKGROUND OF THE INVENTION

Almost everyone has experienced the annoyance of using a tape cutter where the free end of the tape slips back onto and sticks to the roll of tape, thus making it difficult to find and retrieve the free end. For tape cutters used for occasional personal use, this may be merely an annoyance. However, for tape cutters used in commercial applications, this can result in significant inefficiencies.

There are many known and patented devices for dispensing and cutting material. Many of these devices are core mounted devices for dispensing and cutting tape. Applicant's prior patents, U.S. Pat. Des. Nos. 299,036 and 4,711,384 are generally representative of the basic structure and operation of core mounted, one-piece tape cutters. Applicant's prior patents do not include, however, any element which serves to restrain or trap the free end of the tape. Most prior known tape cutters merely rely on the tape sticking to the blade or a support area to try to keep the free end ready for use. In addition to applicant's prior patents, other core mounted tape cutters are shown in U.S. Pat. Nos. 2,677,425; 2,717,641; 2,734,575; and 3,684,141. None of these prior known core mounted tape cutters, however, provide effective means for preventing the free end of the tape from being withdrawn onto and sticking to the roll of tape.

There are a number of known devices which have tried to solve the problem of maintaining the free end of tape in an operative position. These devices, however, either are not core mounted tape dispensers, or involve complex structures which are expensive to manufacture and difficult to operate. For example, Handler, U.S. Pat. No. 5,009,351, discloses a box for flexible sheet material such as plastic wrap. The box includes a flap which serves as a "biasing means" for pressing the sheet material into light frictional contact with an abrasive element within the box. The frictional contact between the resilient flap and the abrasive material is sufficiently great that the new free end, created when a portion of the sheet material is severed by cutting, is restrained from reentering the box. Of course, this device is not a tape mounted cutter.

Holoff, U.S. Pat. No. 4,344,813, discloses a complex tape dispenser in which a leaf spring causes a tape support bar to press a tape gripping member against a guide wall thereby pinching the tape tightly between the tape gripping bar and the tape support bar. This structure, however, is complex and expensive to manufacture.

Schleicher, U.S. Pat. No. 4,238,272, discloses a tape dispenser in which a leaf spring having a lower arm is resiliently biased to pinch the free end of the tape against an edge of an opening in the tape dispenser. The protruding end portion of the tape acts in a self-starting capacity for the next tape dispensing operation. This device also is not a simple core-mounted device, but is a housing which fully encloses the tape.

Thus, there is no known effective and inexpensive tape cutter which retains the free end of tape in operative position.

SUMMARY OF THE INVENTION

The tape cutter of the present invention, in its preferred form, is a one-piece, plastic, core mounted cutter which fits over a roll of tape. The cutter preferably includes a blade which is elevated above the plane of the tape. The tape is withdrawn tangentially from the tape roll between tape tabs, which support the tape, and a tape trap, which presses the tape against the tabs. The tape trap preferably is a spring loaded projection connected to the body of the cutter at the base of the elevated blade. The tape trap is hingedly connected to the base of the blade so that it presses against the tape tabs with a spring action. In the preferred form of the invention, a living hinge connects the tape trap to the body of the cutter. Preferably, the cutter is made from polypropylene, polyethylene, or a similar material.

In use, tape is pulled from the roll between the tape trap and the tape tabs of the cutter. The flexible action of the tape trap is designed to lift up to allow the tape to feed between the tape and trap. When the tape is cut, the spring action of the trap presses the tape against the tabs to prevent the tape from being withdrawn onto the roll of tape.

DETAILED DESCRIPTION

Figure 1:
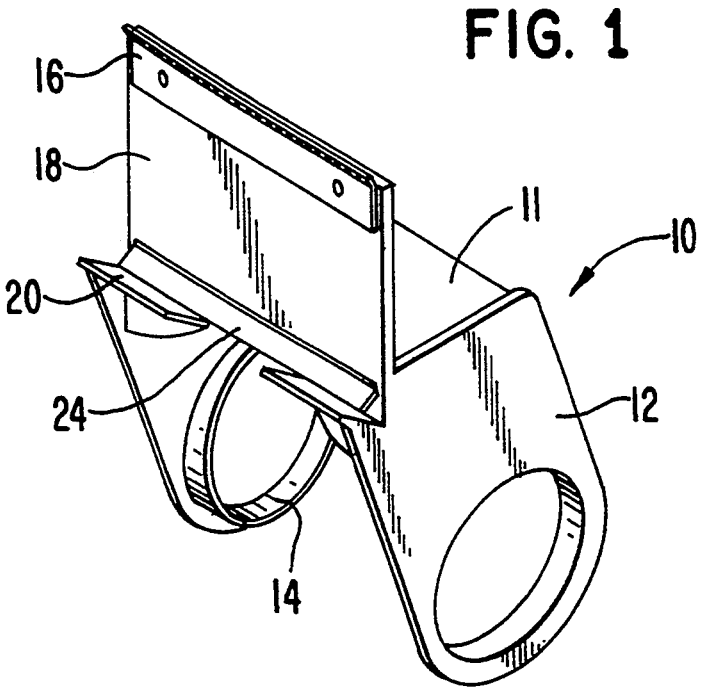
FIG. 1 is a perspective view of a preferred form of the invention.
Figure 2:
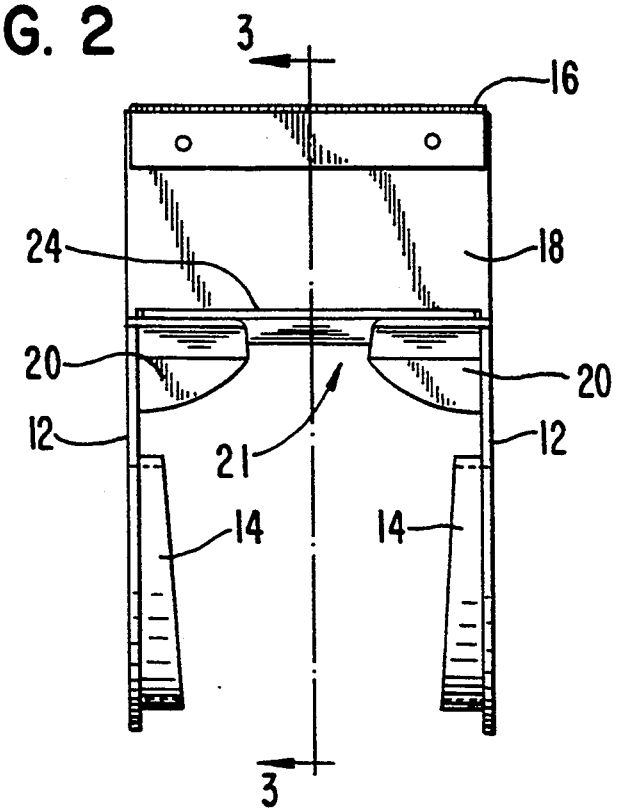
FIG. 2 is front view of the tape cutter shown in FIG. 1.

A tape cutter according to the invention is shown generally at 10. Tape cutter 10 body includes a top wall 11 and sidewalls 12. Sidewalls 12 are intended to fit over a roll of tape, shown in phantom outline in FIG. 3. Top wall 11 may include a thumb rest to facilitate using the cutter. Sidewalls 12 each include an inwardly projecting shoulder 14. Shoulders 14 fit into the open core of a roll of tape. Sidewalls 12 and shoulders 14 serve to hold the tape cutter onto the roll of tape. The general way in which the cutter fits over a roll of tape and is held by the user is shown in applicant's prior U.S. Pat. No. 4,711,384.

Tape cutter 10 also includes a cutter blade 16. As shown, the blade is a separate element which is attached to a cutter arm 18 projecting upwardly from the body of the tape cutter. In the preferred form of the invention, the tape cutter is made from a plastic, preferably polypropylene. The cutter blade as shown could be a metal. Alternatively, the cutting blade could be plastic and could be formed integrally with the cutter body.

The cutter body has at least one non-rotatable tab 20 for supporting the free end portion 22 of the tape. In the preferred form of the invention there are two tabs. Preferably, the tabs 20 extend inwardly from the sidewalls 12 in opposing relationship. Also, in the preferred form of the invention, tabs 20 extend across less than the full width of said body so that the end portions are in spaced relation and define therebetween a gap 21. The size of gap 21 is determined to insure that tabs 20 provide sufficient surface area to support the width of the tape without buckling. The bottom surfaces of tabs 20 may be rounded to thereby facilitate threading the free end portion 22 of the tape through the gap 21 onto the top surface of tabs 20. Tabs 20 may also include a downwardly extending leg portion, as shown clearly in FIGS. 3 and 4. The bottom edge of this leg portion may be rounded upwardly to thereby facilitate automatically feeding the free end of the tape through the gap 21 onto the tabs. Tabs 20 are positioned a sufficient distance above shoulders 14 so that the tape cutter will accommodate the size of a roll of tape for which it is intended. Generally, the tabs should be approximately one-quarter inch above the top layer of a full roll of tape.

The tape cutter body further includes a trap 24 connected to body. Trap 24 extends across the full width of the tape cutter body. This not only helps to maintain the tape in proper position on the tabs 20, but also prevents the tape from wrinkling or buckling in the center.

Figure 4:
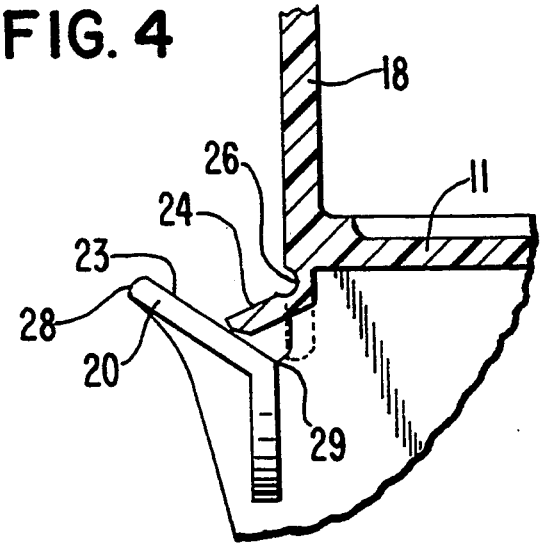
FIG. 4 is a portion of the sectional view in FIG. 3, showing in enlarged detail the tape trap and tab of the invention.

The trap 24 is preferably flexibly connected to the tape body by a hinge 26. In the preferred form of the invention, hinge 26 is a living hinge integrally formed with the tape cutter body. Hinge 26 is preferably formed by an area of reduced thickness between trap 24 and the cutter body, as shown in FIG. 4. The trap 24 cooperates with the upper surfaces 23 of tabs 20 to restrain the free end portion 22 of the tape between the trap and tabs. Preferably, hinge 26 urges trap 24 towards tabs 20 so that trap 24 frictionally engages tab 20 so that tape may be held therebetween. The trap 24 and tabs 20 thereby prevent the free end portion from being withdrawn onto the roll of tape.

In the preferred form of the invention, the tape is a traditional adhesive tape which has an adhesive side and a non-adhesive side, although tape with a double-sided adhesive clearly can also be used in the invention. When using a single-sided adhesive tape, tabs 20 support the adhesive side of the tape and trap 24 engages the non-adhesive side of the tape.

The upper surfaces 23 of tabs 20 are positioned at a predetermined angle with respect to the tape cutter body. The predetermined angle is such that the upper surfaces 23 of the tabs are located on a line substantially tangent to the outer diameter of the tape core that holds a roll of tape being held by the tape cutter 10. If this angle becomes more horizontal so that it approaches being horizontal with the top wall 11 of the cutter, the performance of the cutter is not as effective, since the trap will cause the tape to bind on the tabs.

Figure 3:
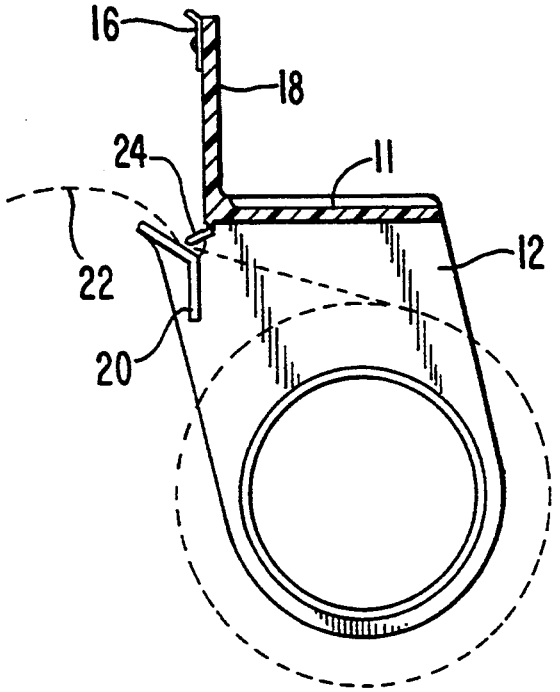
FIG. 3 is a sectional view taken along line 3—3 of FIG. 2.

In the preferred form of the invention the distance from the point where the trap 24 engages tabs 20 to the front edge 28 of the tabs 20 is greater than the distance from the point where the trap engages said tab to the rear edge of the tab. This provides an effective support surface for the free end of the tape. Additionally is desirable to keep the distance from the point where trap 24 engages tabs 20 to the rear edge 29 of tabs 20 as short as possible, since this will avoid providing a large surface area to which tape can stick and thus inhibit easy application. Also cutting blade 16 is located on cutting arm 18 at a fixed height above tabs 20 and trap 24. The fixed height is greater than the distance from the point where trap 24 engages tabs 20 to the front edge 28 of the tabs. This assures that the length of the free end of tape after the tape is cut by blade 16 will be sufficiently long to overhang the tabs 20, as shown in FIG. 3.

Figure 6:
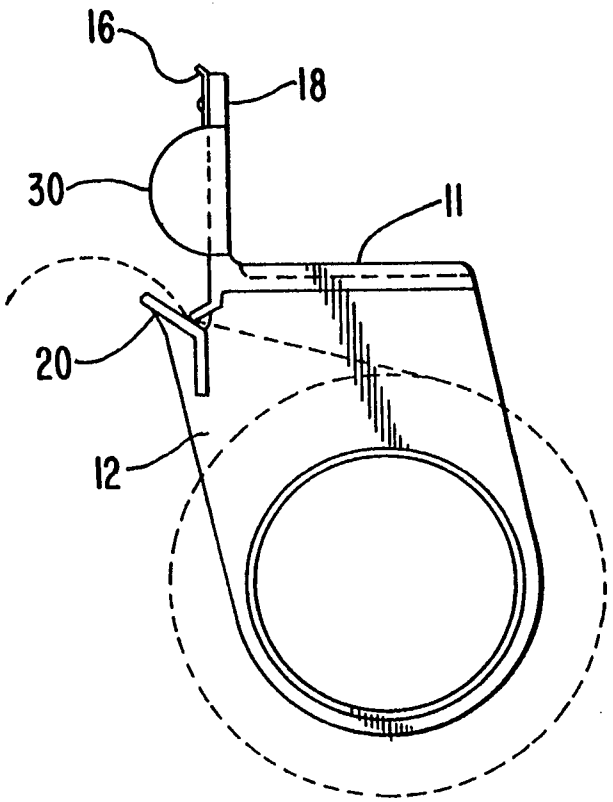
FIG. 6 is a side view of a still further alternate form of the invention.
Figure 5:
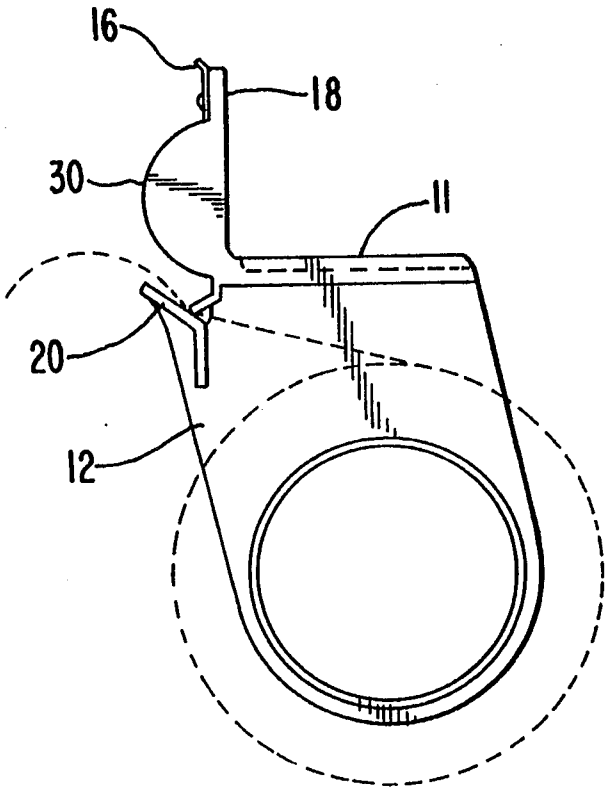
FIG. 5 is a side view of an alternate form of the invention.

In an alternative form of the invention tape cutter 10 may further include tape holding means, such as projection 30, for holding the tape in position against a tape receiving surface when the tape is cut. The tape holding means allows for one hand operation for dispensing and cutting tape, which often is very desirable. Preferably, projection 30 is fixed to the cutting arm 18 as shown in FIG. 5. The tape holding means may be removably connected to said cutting arm by a simple snap fit, as shown in FIG. 6. This may be necessary because the die or molding process used to make the tape cutter may not accommodate projection 30 being integrally formed on cutting arm 18. However, within the scope of the invention, the tape cutting means clearly may integrally formed with cutting arm 18.

Projection 30 projects from cutting arm 18 and has a substantially rounded outer surface in the preferred form of the invention. However, other shapes for projection 30 also may be used. Projection 30 merely must have sufficient surface area to be able to press and hold the tape against the tape receiving surface as the tape is being applied and severed. Preferably, the front surface of projection 30 is substantially coplanar with the front edge 28 of tabs 20.

The process of making the tape cutter 10 of the present invention is as follows. The body, including top wall 11, sidewalls 12, projections 14, along with curing arm 18, tabs 20, trap 24, and hinge 26 are all integrally formed, typically by molding in a die. It may be necessary to have tabs 20 of a uniform thickness throughout for effective molding and to avoid warping. The projection 30 and cutting blade 16 also may be integrally molded if the die and molding process will so permit. Otherwise, blade 16 and projection 30 may be separately attached. It would be difficult to mold trap 24 and hinge 26 into proper position with the proper tolerances and spring tension. Accordingly, the cutter is molded with trap 24 in a manufacturing position, as shown in dotted outline in FIG. 4, wherein trap 24 does not engage tabs 20. After molding, trap 24 is moved into an operating position, as shown in FIG. 4, wherein trap 24 frictionally engages tabs 20 to thereby restrain the free end portion of the tape between the trap and the tabs and thereby prevent the free end portion from being withdrawn onto the roll of tape. As a result of the polytype material from which the tape cutter is preferably made and as a result of moving trap 24 from its manufacturing position to its operating position, trap 24 will have a tendency to return to its original manufacturing position. This tendency is what creates the living hinge and the spring bias of trap 24 against tabs 20.

Although a preferred form of the invention has been shown and described in accordance with the best mode of practicing the invention known to the inventor, the invention is not to be limited thereto, but is to be defined only by the following claims.

I claim:

1. A dispensing and cutting device for tape having a body for holding a roll of tape and cutting means fixed to said body for cutting the tape, the roll of tape held on a core having an outer diameter, and the roll of tape further having an outer periphery and a free end portion on said outer periphery, the improvement comprising:

said body having two non-rotatable tabs for supporting the free end portion of the tape, said tabs including upper surfaces;

said body further having opposing spaced side walls defining therebetween a width of said body, wherein said tabs extend inwardly from said sidewalls in opposing relationship and terminate in end portions, and wherein said tabs extend across less than said width of said body so that said end portions are in spaced relation and define therebetween a gap;

said body further having a trap connected to said body, wherein said trap cooperates with said upper surfaces of said tabs to restrain the free end portion of the tape therebetween and thereby prevent the free end portion from being withdrawn onto the roll of tape;

further wherein said upper surfaces of said tabs are positioned at a predetermined angle, and wherein said predetermined angle is such that said upper surfaces of said tabs are located on a line tangent to the outer diameter of the tape core that holds a roll of tape being held by the body, said predetermined angle thereby allowing said trap to cooperate with said upper surfaces of said tabs to restrain the free end portion of the tape therebetween, and said predetermined angle further allowing the tape to move over said tabs without binding on said tabs; and further wherein said tape core rotates about a first axis, wherein said tabs include downwardly extending leg portions, wherein said downwardly extending leg portions include bottom edges, and wherein said respective bottom edges of said downwardly extending leg portions are rounded about a second axis disposed perpendicularly to said first axis to thereby facilitate threading the free end portion of the tape through the gap between said end portions of said tabs onto said upper surfaces of said tabs.

2. A dispensing and cutting device as recited in claim 1 wherein said trap is flexibly connected to said body by a hinge.

3. A dispensing and cutting device as recited in claim 2 wherein said hinge is a living hinge integrally formed with said body.

4. A dispensing and cutting device as recited in claim 1 wherein said device further comprises tape holding means for holding the tape in position against a tape receiving surface when the tape is cut.

5. A dispensing and cutting device as recited in claim 4, wherein said tape body further comprises a cutting arm projecting from said body, wherein said cutting means is fixed to said cutting arm, and wherein said tape holding means is fixed to said cutting arm.

6. A dispensing and cutting device as recited in claim 5 wherein said tape holding means is removably connected to said cutting arm.

7. A dispensing and cutting device as recited in claim 5 wherein said tape holding means comprises a projection projecting from said cutting arm.

8. A dispensing and cutting device as recited in claim 7 wherein said projection has a substantially rounded outer surface.

9. A dispensing and cutting device as recited in claim 7 wherein each of said tabs includes a first edge disposed adjacent to said tape core and a second edge disposed at a distance further from said tape core than said first edge, wherein said projection has a front surface, and further wherein the front surface of said projection is substantially coplanar with said second edge of each of said tabs.

10. A dispensing and cutting device as recited in claim 1 wherein said trap extends fully across said width of said body.

11. A dispensing and cutting device as recited in claim 1 wherein said cutting means is located on said body at a predetermined height above said tabs and said trap.

12. A dispensing and cutting device as recited in claim 1 wherein said trap is moveable.

13. A dispensing and cutting device as recited in claim 1 wherein the tape has an adhesive side and a non-adhesive side, and wherein said tabs support the adhesive side of the tape, and wherein said trap engages the non-adhesive side of the tape.

14. A dispensing and cutting device for tape having a body for holding a roll of tape and cutting means fixed to said body for cutting the tape, the roll of tape held on a core having an outer diameter, and the roll of tape further having an outer periphery and a free end portion on said outer periphery, the improvement comprising:

said body having two non-rotatable tabs for supporting the free end portion of the tape, said tabs including upper surfaces;

said body further having opposing spaced side walls defining therebetween a width of said body, wherein said tabs extend inwardly from said sidewalls in opposing relationship and terminate in end portions, and wherein said tabs extend across less than said width of said body so that said end portions are in spaced relation and define therebetween a gap;

said body further having a trap connected to said body, wherein said trap is flexibly connected to said body by a hinge, wherein said hinge is a living hinge integrally formed with said body, and wherein said trap cooperates with said upper surfaces of said tabs to restrain the free end portion of the tape therebetween and thereby prevent the free end portion from being withdrawn onto the roll of tape, further wherein said upper surfaces of said tabs are positioned at a predetermined angle, wherein said predetermined angle is such that said upper surfaces of said tabs are located on a line tangent to the outer diameter of the tape core that holds a roll of tape being held by the body, said predetermined angle thereby allowing said trap to cooperate with said upper surfaces of said tabs to restrain the free end portion of the tape therebetween, and said predetermined angle further allowing the tape to move over said tabs without binding on said tabs, and further wherein each of said tabs includes a first edge and a second edge, said first edge disposed adjacent to said tape core and said second edge disposed at a distance further from said tape core than said first edge, wherein said trap frictionally engages each said tab at a point closer to said first edge of each said tab than to said second edge of each said tab.

15. A dispensing and cutting device as recited in claim 14 wherein said cutting means is located on said body at a predetermined height above said tabs and said trap, and wherein said predetermined height is greater than a distance defined by said point where said trap frictionally engages each said tab and said second edge of each said tab.

* * * * *